US005410976A

United States Patent [19]

Matsubara

[11] Patent Number: 5,410,976

[45] Date of Patent: May 2, 1995

[54] SEWING MACHINE HAVING AN EMBROIDERY FUNCTION

[75] Inventor: Kenji Matsubara, Nagoya, Japan

[73] Assignee: Brother Kogyo Kabushiki Kaisha, Nagoya, Japan

[21] Appl. No.: 223,226

[22] Filed: Apr. 5, 1994

[30] Foreign Application Priority Data

Apr. 12, 1993 [JP] Japan ..... 5-084377

[51] Int. Cl.[6] ..... D05B 21/00; D05C 9/06

[52] U.S. Cl. ..... 112/121.12; 112/103; 112/266.1

[58] Field of Search ..... 112/121.12, 103, 121.11, 112/456, 457, 262.3, 266.1; 364/470

[56] References Cited

U.S. PATENT DOCUMENTS 4,849,902 7/1989 Yokoe et al. .
4,964,352 10/1990 Yokoe et al. ..... 112/121.12
5,151,863 9/1992 Komuro et al. .
5,216,615 6/1993 Yokoe et al. ..... 112/121.12 X
5,320,054 6/1994 Asano ..... 112/121.12

*Primary Examiner*—Peter Nerbun
*Attorney, Agent, or Firm*—Oliff & Berridge

[57] ABSTRACT

When two patterns overlap each other and an over stitch block in one of the two patterns divides an under stitch block in the other pattern, a first correction processing is performed so as to divide the under stitch block into two stitch blocks. Then, a second correction processing is performed as follows. A degree of hardening of the stitch embroidery portion resulting from a tightening of the threads of the embroideries in an overlapped portion between the over and under stitch blocks to a workpiece is first determined according to reference directions of the stitch blocks and positions of intersections of the stitch blocks. Then, the higher the degree of tightening, the more the area of the overlapped portion of the under stitch block near the boundary between the stitch blocks is left, whereas the lower the degree of tightening, the more this area is eliminated. Finally, an embroidery frame moving mechanism is controlled according to the corrected stitch data.

19 Claims, 12 Drawing Sheets

Fig.8

16A

| PATTERN | PATTERN NUMBER M | STITCH BLOCK | BLOCK NUMBER B | REPRESENTING POINTS FIRST POINT | SECOND POINT | THIRD POINT | FORTH POINT |
|---|---|---|---|---|---|---|---|
| T | 1 | T1 | 1 | P1 | P2 | P3 | P4 |
| | | T2 | 2 | P5 | P6 | P7 | P8 |
| E | 2 | E1 | 1 | P9 | P10 | P11 | P12 |
| | | E2 | 2 | P9 | P13 | P14 | P15 |
| | | E3 | 3 | P16 | P17 | P18 | P19 |
| | | E4 | 4 | P20 | P11 | P21 | P22 |
| L | 3 | L1 | 1 | P23 | P24 | P25 | P26 |
| | | L2 | 2 | P27 | P25 | P28 | P29 |
| - | 4 | R1 | 1 | P30 | P31 | P32 | P33 |
| 4 | 5 | F1 | 1 | P42 | P39 | P32 | P34 |
| | | F2 | 2 | P38 | P39 | P40 | P41 |
| | | F3 | 3 | P34 | P35 | P36 | P37 |
| | | F4 | 4 | P43 | P44 | P45 | P46 |

Fig.9

16B

| PATTERN | PATTERN NUMBER M | STITCH BLOCK | BLOCK NUMBER B | REPRESENTING POINTS FIRST POINT | SECOND POINT | THIRD POINT | FORTH POINT |
|---|---|---|---|---|---|---|---|
| T | 1 | T1 | 1 | P1 | P2 | P3 | P4 |
| | | T2 | 2 | P5 | P6 | P7 | P8 |
| E | 2 | E1 | 1 | P9 | P10 | P11 | P12 |
| | | E2 | 2 | P9 | P13 | P14 | P15 |
| | | E3 | 3 | P16 | P17 | P18 | P19 |
| | | HE1 | 4 | P20 | P11 | H1 | H2 |
| | | HE2 | 5 | H1 | H2 | P21 | P22 |
| L | 3 | L1 | 1 | P23 | P24 | P25 | P26 |
| | | L2 | 2 | P27 | P25 | P28 | P29 |
| - | 4 | R1 | 1 | P30 | P31 | P32 | P33 |
| 4 | 5 | F1 | 1 | P42 | P39 | P32 | P34 |
| | | F2 | 2 | P38 | P39 | P40 | P41 |
| | | F3 | 3 | P34 | P35 | P36 | P37 |
| | | F4 | 4 | P43 | P44 | P45 | P46 |

Fig.10

16C

| PATTERN | PATTERN NUMBER M | STITCH BLOCK | BLOCK NUMBER B | REPRESENTING POINTS FIRST POINT | SECOND POINT | THIRD POINT | FORTH POINT |
|---|---|---|---|---|---|---|---|
| T | 1 | T1 | 1 | P1 | P2 | P3 | P4 |
| | | HT1 | 2 | P5 | P6 | H4 | H3 |
| | | HT2 | 3 | H5 | H3 | H6 | P8 |
| E | 2 | E1 | 1 | P9 | P10 | P11 | P12 |
| | | E2 | 2 | P9 | P13 | P14 | P15 |
| | | HE3 | 3 | P16 | P17 | H7 | H8 |
| | | HE4 | 4 | H7 | H9 | H12 | H10 |
| | | HE5 | 5 | H12 | H11 | P18 | P19 |
| | | HE6 | 6 | P20 | P11 | H13 | H14 |
| | | HE7 | 7 | H16 | H15 | P21 | P22 |
| L | 3 | L1 | 1 | P23 | P24 | P25 | P26 |
| | | L2 | 2 | P27 | P25 | P28 | P29 |
| - | 4 | HR1 | 1 | P30 | P31 | H17 | H18 |
| 4 | 5 | F1 | 1 | P42 | P39 | P32 | P34 |
| | | F2 | 2 | P38 | P39 | P40 | P41 |
| | | F3 | 3 | P34 | P35 | P36 | P37 |
| | | F4 | 4 | P43 | P44 | P45 | P46 |

FIG. 11B

| DIVISION OF OVERLAPPED BLOCK | |
|---|---|
| S10 | INITIALIZATION, M1←1, B1←1, M2←2, B2←1 |
| S12 | (M1, B1) BLOCK AND (M2, B2) BLOCK OVERLAP EACH OTHER ? |
| S13 | (M1, B1) BLOCK DIVIDED INTO TWO SUB-BLOCKS BY (M2, B2) BLOCK ? |
| S14 | BISECT OVERLAPPED PORTION BETWEEN (M1, B1) BLOCK AND (M2, B2) BLOCK |
| S15 | DIVIDE (M1, B1) BLOCK INTO TWO SUBBLOCKS AND SUBSTITUTE THEM FOR (M1, B1) BLOCK |
| S16 | IS B2 BLOCK A FINAL BLOCK IN M2 PATTERN ? |
| S17 | B2←B2+1 |
| S18 | IS M2 PATTERN A FINAL PATTERN IN COMBINATION OF PATTERNS ? |
| S19 | M2←M2+1, B2←1 |
| S20 | IS B2 BLOCK A FINAL BLOCK IN M1 PATTERN ? |
| S21 | B1←B1+1 |
| S22 | IS M1 PATTERN A PATTERN JUST BEFORE A FINAL PATTERN IN COMBINATION OF PATTERNS ? |
| S23 | M1←M1+1, B1←1 |
| S24 | M2←M1+1, B2←1 |

FIG. 12B

| PARTIAL ELIMINATION OF OVERLAPPED PORTION | |
|---|---|
| S40 | INITIALIZATION, M1←1, B1←1, M2←2, B2←1 |
| S41 | (M1, B1) BLOCK AND (M2, B2) BLOCK OVERLAP EACH OTHER ? |
| S42 | REFERENCE DIRECTIONS INTERSECT EACH OTHER ? |
| S44 | TWO INTERSECTIONS LIE ON THE SAME SECONDARY LINE OF (M2, B2) BLOCK ? |
| S45 | OVERLAP AMOUNT ← a |
| S46 | OVERLAP AMOUNT ← c |
| S47 | ELIMINATE OVERLAPPED PORTION OF (M1, B1) BLOCK ACCORDING TO VALUE OF a, b, or c |
| S48 | IS B2 BLOCK A FINAL BLOCK IN M2 PATTERN ? |
| S49 | B2←B2+1 |
| S50 | IS M2 PATTERN A FINAL PATTERN IN COMBINATION OF PATTERNS ? |
| S51 | M2←M2+1, B2←1 |
| S52 | IS B1 BLOCK A FINAL BLOCK IN M1 PATTERN ? |
| S53 | B1←B1+1 |
| S54 | IS M1 PATTERN A PATTERN JUST BEFORE A FINAL PATTERN IN COMBINATION OF PATTERNS ? |
| S55 | M1←M1+1, B1←1 |
| S56 | M2←M1+1, B2←1 |
| S60 | TWO INTERSECTION LIE ON THE SAME PRIMARY LINE OF (M2, B2) BLOCK ? |
| S62 | OVERLAP AMOUNT ← b ALONG PRIMARY LINE OF (M1, B1) BLOCK |
| S63 | OVERLAP AMOUNT ← b ALONG SECONDARY LINE OF (M1, B1) BLOCK |

SEWING MACHINE HAVING AN EMBROIDERY FUNCTION

BACKGROUND OF THE INVENTION

1. Field of the Invention

The present invention relates to an embroidery sewing machine for embroidering designated patterns.

2. Description of Related Art

Such a sewing machine employs a ROM card. The ROM card has a memory area for storing stitch data relating to sewing a plurality of patterns. These patterns are individually formed according to the respective stitch data. When the ROM card is loaded into the sewing machine, desired patterns can be selected.

In embroidering two patterns to overlap on each other, the two patterns and their embroidering positions are first designated. Thereafter, one of the two patterns is formed in accordance with its corresponding shape preliminarily stored, and then the other pattern is formed in accordance with its corresponding shape preliminarily stored. Further, in an overlapped portion between the two patterns, an embroidery portion in one of the two patterns is formed over an embroidery portion in the other pattern previously formed.

However, the stitched embroidery portion is hardened by tightening of the threads. Accordingly, if embroidery is repeated many times in the embroidery portion, the needle may become bent, causing a problem such that stitches cannot be properly formed, which reduces the embroidery quality. Furthermore, if the needle is bent to some extent, there is a possibility that the needle may be caught by the presser foot or the throat plate, which will jam the machine.

SUMMARY OF THE INVENTION

It is accordingly an object of the present invention to provide a sewing machine that can prevent a needle from being bent and will embroider with a high quality.

According to the present invention, a sewing machine is provided comprising storing means for preliminarily storing stitch data relating to a plurality of patterns, selecting means for selecting desired ones of the patterns to be formed according to the stitch data, and arranging means for arranging the selected patterns so that the selected patterns at least partially overlap each other. An overlap detecting means detects an overlapped portion between a first pattern of the overlapped patterns and a second pattern of the overlapped patterns over the first pattern. Then, correcting means corrects the stitch data so that an embroidery density in the overlapped portion of the first pattern is reduced, and pattern forming means forms the selected patterns by embroidering on a workpiece according to the corrected stitch data.

The sewing machine mentioned above may further comprise degree detecting means for detecting a degree of hardening of the stitched embroidery portion in the first pattern and the stitched embroidery portion in the second pattern to the workpiece in a boundary portion between the first pattern and the second pattern by tightening of the threads. The correcting means corrects the stitch data of the first pattern so that with a higher the degree of tension, more embroidery in the overlapped portion in the vicinity of the boundary portion is left. Whereas with a lower degree of tension, more of the embroidery in the overlapped portion is eliminated.

Other objects and features of the invention will be more fully understood from the following detailed description and appended claims when taken with the accompanying drawings.

BRIEF DESCRIPTION OF THE DRAWINGS

FIG. 8 is a table showing stitch data before the first correction processing;

FIG. 9 is a table showing stitch data after the first correction processing;

FIG. 10 is a table showing stitch data after the second correction processing;

FIG. 11B is a table corresponding to the flowchart of FIG. 11A listing the steps of the flowchart;

FIG. 12B is a table corresponding to the flowchart of FIG. 12A listing the steps of the flowchart.

DESCRIPTION OF PREFERRED EMBODIMENTS

Figure 1:
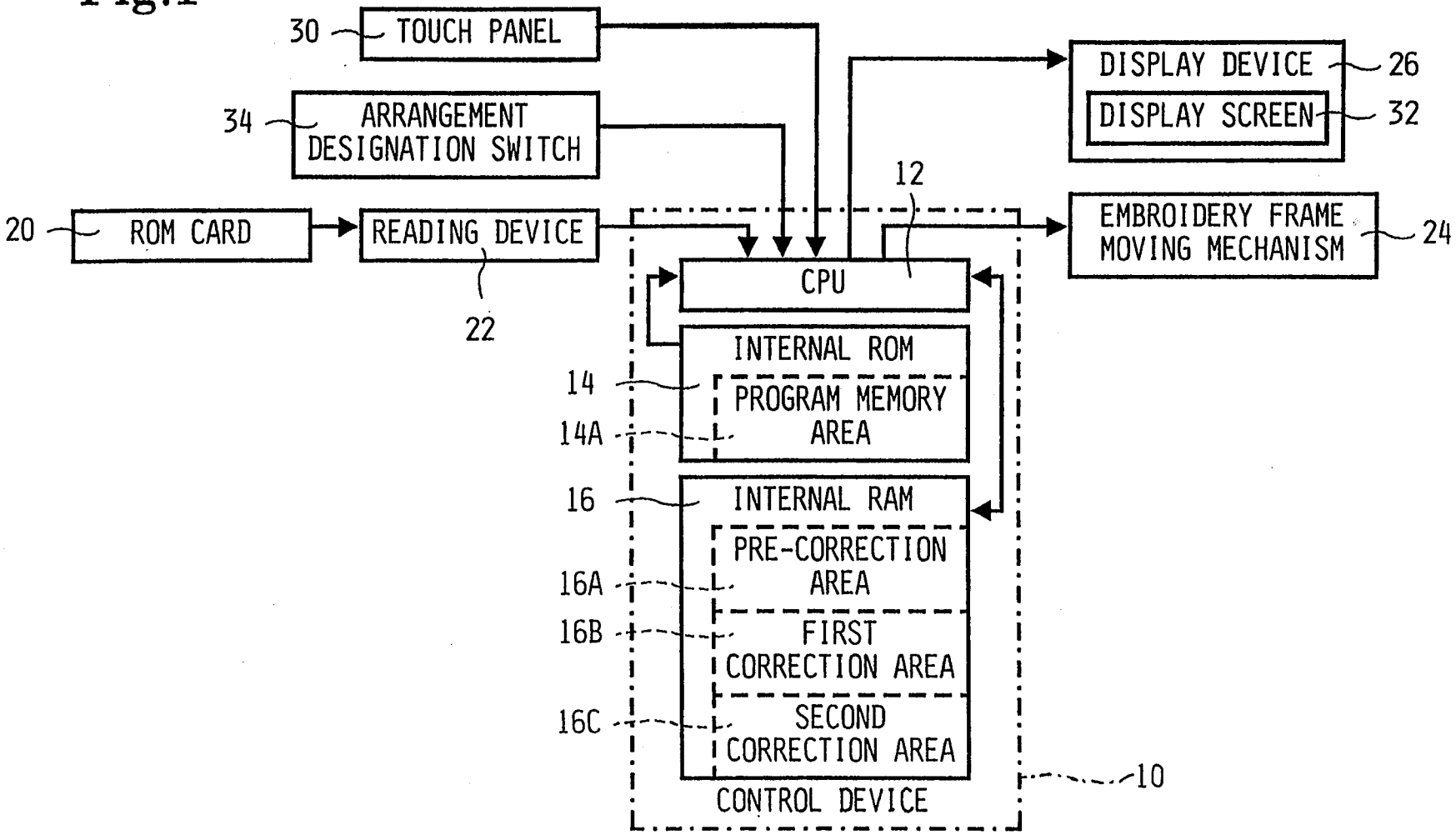
FIG. 1 is a block diagram showing an electrical construction in the sewing machine.

Referring to FIG. 1, a control device 10 controls a sewing machine according to the present invention. The control device 10 is generally constructed of a CPU 12 as a computing device and an internal ROM 14 and internal RAM 16, both storing devices.

Figure 11A:
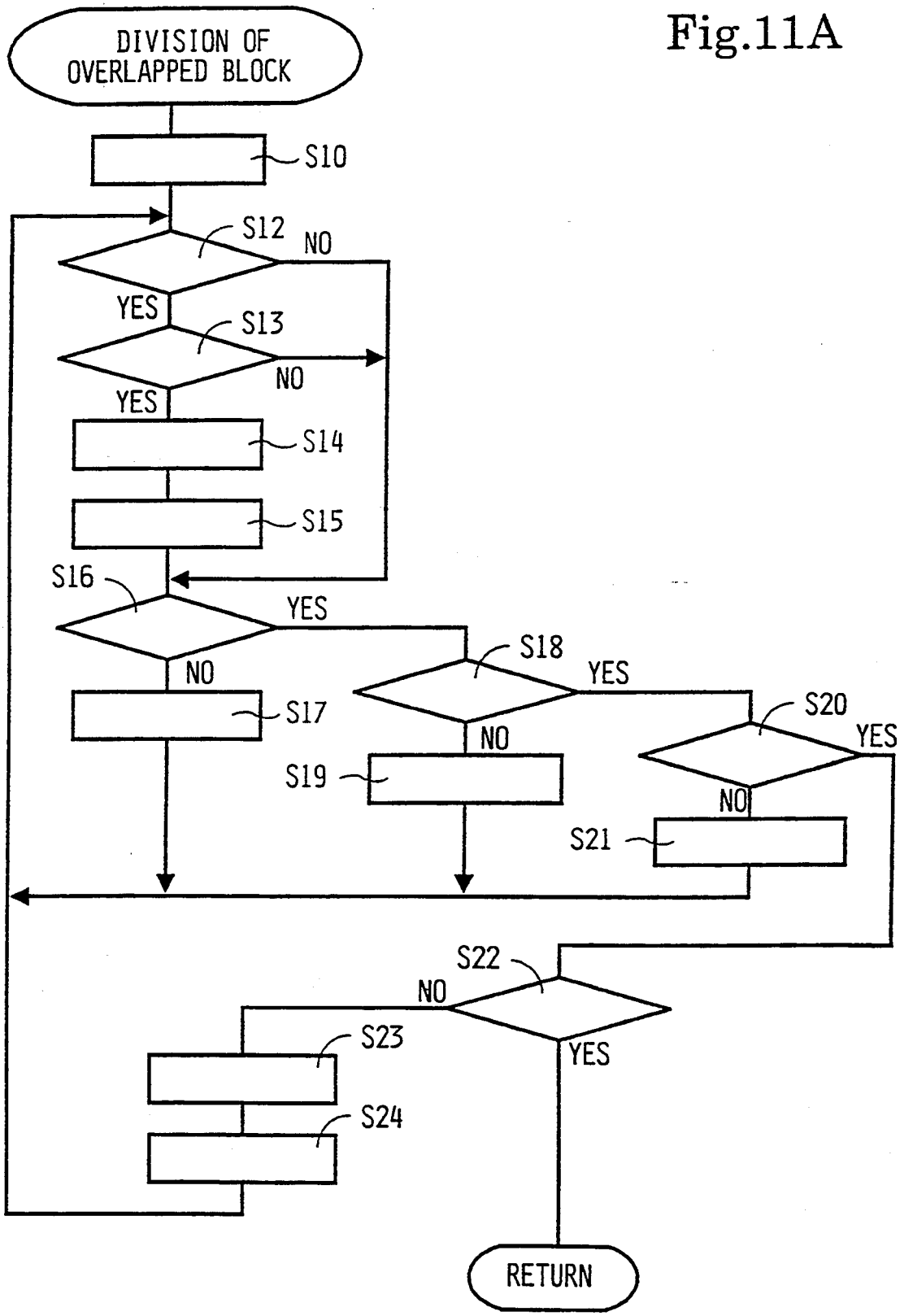
FIG. 11A is a flowchart showing the first correction processing.
Figure 12A:
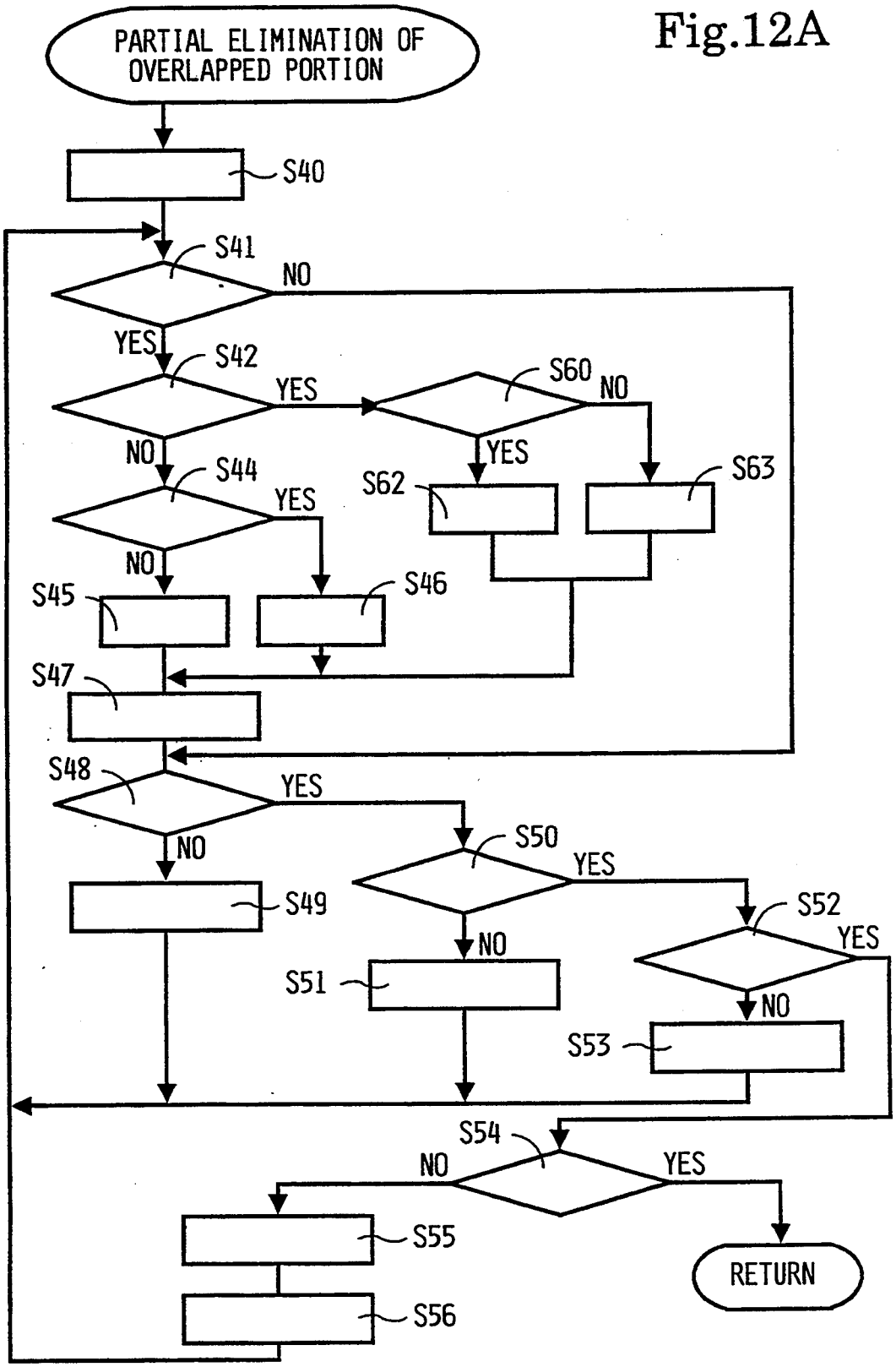
FIG. 12A is a flowchart showing a second correction processing to be performed in a sewing machine according to the present invention.

The internal ROM 14 includes a program memory area 14A preliminarily storing various programs such as a known control program for controlling the sewing machine, a known pattern edit program and block data expansion program for editing patterns, and a correction program for correcting a manner of overlap between a plurality of patterns in accordance with the flowcharts shown in FIGS. 11A and 12A. The internal RAM 16 includes a memory area in which data is written by the CPU 12.

The CPU 12 is adapted to read data stored in a known ROM card 20 through a reading device 22. The ROM card 20 includes a memory area preliminarily storing stitch data relating to sewing of a plurality of patterns. These patterns are individually formed according to the respective stitch data. Each stitch data is stored as known block data represented by four points describing a quadrangle. The block data is expanded by the block data expansion program to known needle location data represented by feed amounts. Such processing of the stitch data is known from U.S. Pat. Nos. 4,849,902; and 5,151,863, for example, the disclosures of which are herein incorporated by reference.

Figure 2:
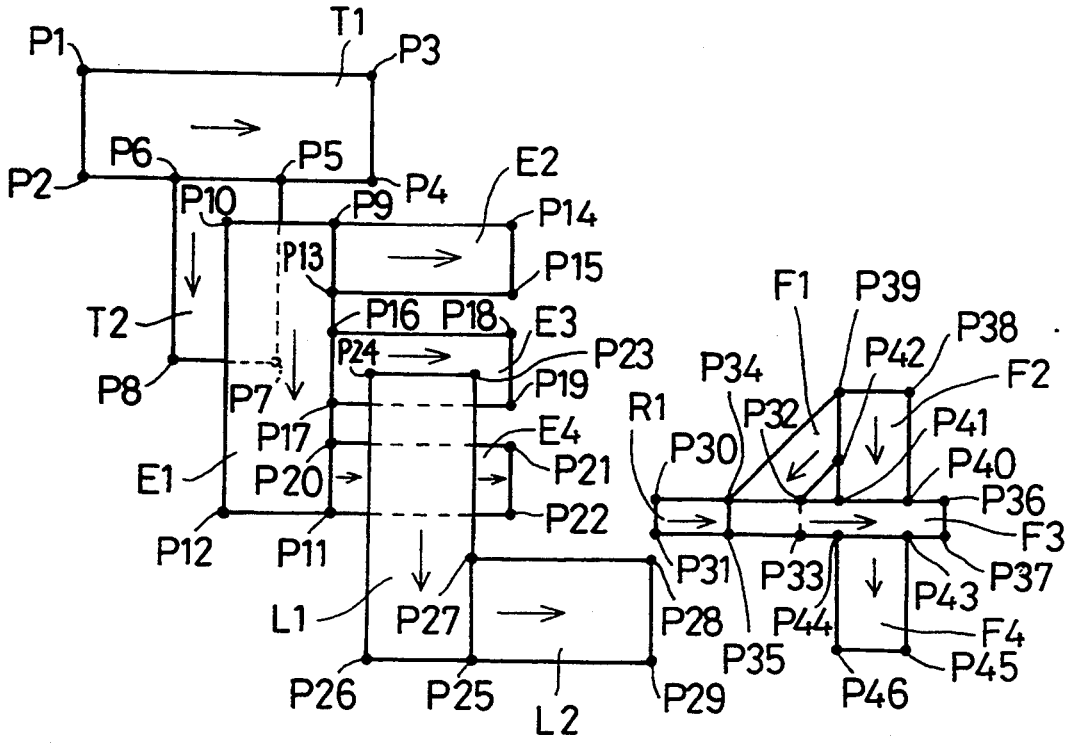
FIG. 2 is a diagram showing a combination of selected patterns.

Referring to FIGS. 1 and 2, the four points representing the block data are referred to as a first point, second point, third point, and fourth point, stored in this order. The direction of advance of stitches is inverted on a line segment connecting the first point and the third point and on a line segment connecting the second point and the fourth point. The line segment connecting the first point and the third point is referred to as a primary line, and the line segment connecting the second point and the fourth point is referred to as a secondary line. Further, the direction from the first point to the third point is referred to as a reference direction (see the arrows in FIG. 2.) In the case of embroidering a certain stitch block and next embroidering another stitch block spaced from the current stitch block, i.e., having no points in common with the current stitch block, a known running stitch process is carried out between an end point of the current stitch block and a start point of the next stitch block according to the block data expansion program. The block data for each stitch block includes thread density data for deciding the number of stitches. The thread density data is set so that four threads intersect in a width of 1 mm to cover a workpiece.

The CPU 12 is connected to a known embroidery frame moving mechanism 24 for moving an embroidery frame in lateral and longitudinal directions of the sewing machine and controls the embroidery frame moving mechanism 24 according to needle location data.

The CPU 12 is also connected to a known display device 26 for displaying the patterns stored in the ROM card 20. A touch panel 30 for selecting a desired pattern from the ones displayed is provided to cover a display screen 32 of the display device 26. The CPU 12 detects the selected patterns according to touch positions in the touch panel 30 touched by an operator. The CPU 12 performs embroidery processing in the sequence of selection of the patterns. As shown in FIG. 8, the stitch data of the selected patterns is stored into a pre-correction area 16A in the internal RAM 16, and a pattern number M and a block number B are allocated to the stitch data in the sequence of selection of the patterns.

The CPU 12 corrects the stitch data stored in the pre-correction area 16A shown in FIG. 8 in accordance with the flowchart shown in FIG. 11A and stores the correction result into a first correction area 16B in the internal RAM 16 as shown in FIG. 9. Thereafter, the CPU 12 corrects the stitch data stored in the first correction area 16B shown in FIG. 9 in accordance with the flowchart shown in FIG. 12A and stores the correction result into a second correction area 16C in the internal RAM 16 as shown in FIG. 10.

The pattern edit program is designed so that a plurality of patterns can be arranged in such a manner as to be at least partially overlapped and be shifted obliquely. Further, an arrangement designation switch 34 for deciding the arrangement of the patterns is connected to the CPU 12. The arrangement designation switch 34 allows the operator to designate four directions (↑, ↓, ← and →), i.e., frontward (up), rearward (down), leftward, and rightward directions. Every time the arrangement designation switch 34 is once touched by the operator, the next pattern is shifted by half its size from the current pattern in a designated direction in accordance with the pattern edit program. Further, when the arrangement designation switch 34 is not operated and the current and next patterns are continuously selected, it is determined that the next pattern is arranged adjacent to the current pattern on the right-hand side thereof.

The correction in embroidering with the patterns overlapped as shown in FIG. 2 by the use of the sewing machine having the above construction occurs as follows. In FIG. 2, a pattern "E" is arranged to overlap a pattern "T" and shift rightward and rearward (or down) from the pattern "T." A pattern "L" is arranged to overlap the pattern "E" and shift rightward and rearward (or down) of the pattern "E". Thus, the pattern "E" is arranged over the pattern "T", and the pattern "L" is arranged over the pattern "E". Further, a pattern "—" (hyphen) is arranged so that the right half thereof is overlapped by a left portion of a pattern "4". Thus, the pattern "4" is arranged over the pattern "—". In FIGS. 4A to 8, the dot-dash line in each pattern schematically shows a direction of formation of stitches, but does not show the stitches themselves.

When the ROM card 20 is loaded into the sewing machine, and the touch panel 30 and the arrangement designation switch 34 are operated to input "T → ↓ E → ↓ L → → → — → 4" in this order, the patterns to be embroidered and the arrangement of the patterns are decided. Thus, as shown in FIG. 8, the stitch data of each pattern is stored into the pre-correction area 16A, and pattern numbers "1," "2" "3" "4" and "5" are allocated to the patterns "T," "E," "L" "—" and "4," respectively. Furthermore a block number B is allocated to each stitch block. In this manner, the patterns to be embroidered and the order of embroidering are stored into the internal RAM 16.

The first correction processing shown by the flowchart in FIG. 11A is performed. In an initialization, the pattern number M1, the block number B1 and the block number B1 are reset to 1 and the pattern number M2 is set to 2 (S10). It is determined that the stitch block T1 in the pattern "T" corresponding to the pattern number M1 (=1) and the block number B1 (=1) has no intersections with the stitch block E1 in the pattern "E" corresponding to the pattern number M2 (=2) and the block number B2 (=1) (S12: No). That is, the stitch block T1 is not overlapped by the stitch block E1. Then, it is determined that the stitch block T1 also has no intersections with the other stitch blocks E2 to E4 in the pattern "E" (S16: No; S17, S12: No). Then, it is determined that the stitch block T1 also has no intersections with the other patterns "L," "—" and "4" (S12: No; S16 to S19)

Figure 4A:
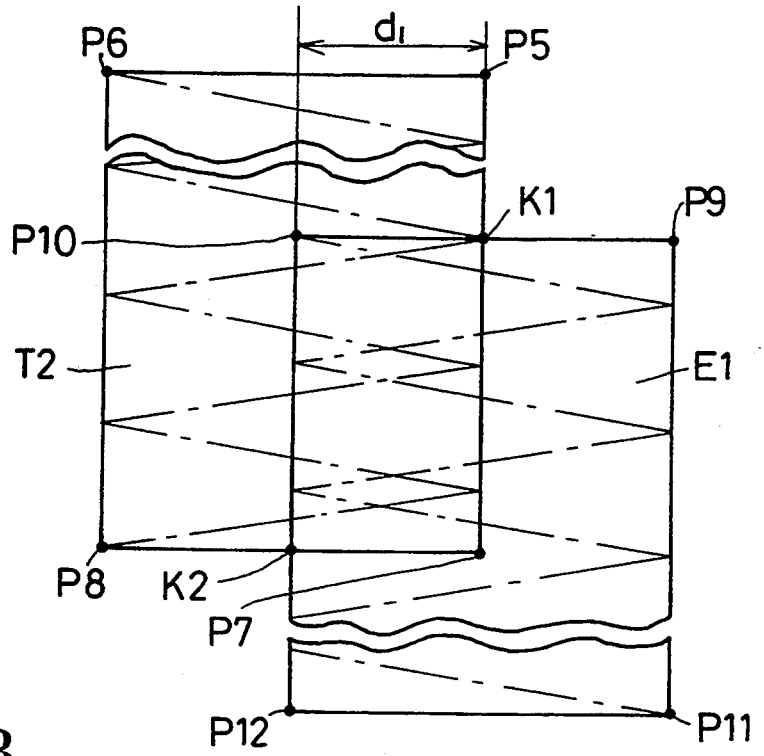
FIG. 4A is a partial diagram showing a first portion before correction by the second correction processing.

Then, the block number B1 in the pattern number M1 (=1) is incremented (S20: No; S21). It is determined that the stitch block T2 in the pattern "T" corresponding to this block number B1 (=2) has two intersections K1 and K2 with the stitch block E1 in the pattern "E" corresponding to the pattern number M2 (=2) and the block number B2 (=1) as shown in FIG. 4A. That is, the pattern "E" does not divide the pattern "T" arranged over the pattern "E" (S12: Yes; S13: No). Then, any intersections between the stitch block T2 and the other stitch blocks E2 to E4 are sequentially checked.

When the intersection check between the stitch block T2 and the other stitch blocks E2 to E4 is completed (S16: Yes), it is determined whether or not the M2 (=2) pattern is a final pattern in combination of patterns. Now, other patterns "L" "—" and "4" still remain (S18: No), therefore the pattern number M2 is incremented and the block number B2 is reset to 1 (S19). Then, any intersections between the stitch block T2 and each stitch blocks of remaining patterns "L" "—" and "4" are sequentially checked in the same manner described above. When the intersection check between the stitch block T2 and the stitch block 54 (the pattern number M2 is 5 and the block number B2 is 4) is completed (S16: Yes; S18: Yes; S20: Yes), it is determined whether or not the M1 (=1) pattern is a pattern just before the final pattern in combination of patterns Now, other patterns "E" "L" and "—" still remain just before the final pattern "4" (S22: No), therefore the pattern number M1 is incremented and the block number B1 is reset to 1 (S23). Then, the pattern number M2 is set to a number M1+1 and the block number B2 is reset to 1 (S24). Then, any intersections between the stitch block E1 and each stitch block of remaining patterns "L", "—" and "4" are sequentially checked in the same manner described above.

Figure 5A:
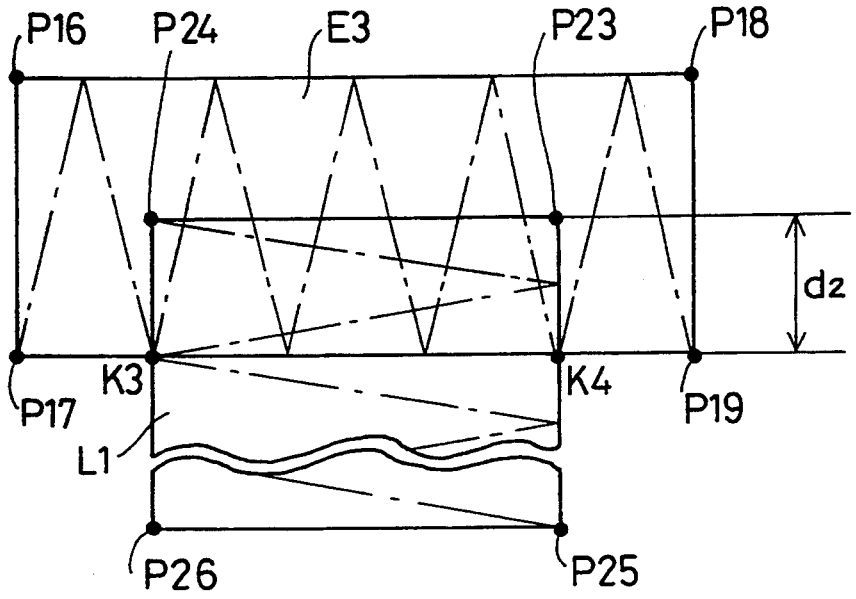
FIG. 5A is a partial diagram showing a second portion before correction by the second correction processing.

Then, it is determined that the stitch block E3 in the pattern "E" corresponding to the pattern number M1 (=2) and the block number B1 (=3) has two intersections K3 and K4 with the stitch block L1 in the pattern "L" corresponding to the pattern number M2 (=3) and the block number B2 (=1) as shown in FIG. 5A (S12: Yes; S13: No). Then, any intersections between the stitch block E3 and the other stitch block L2 are checked.

Figure 3:
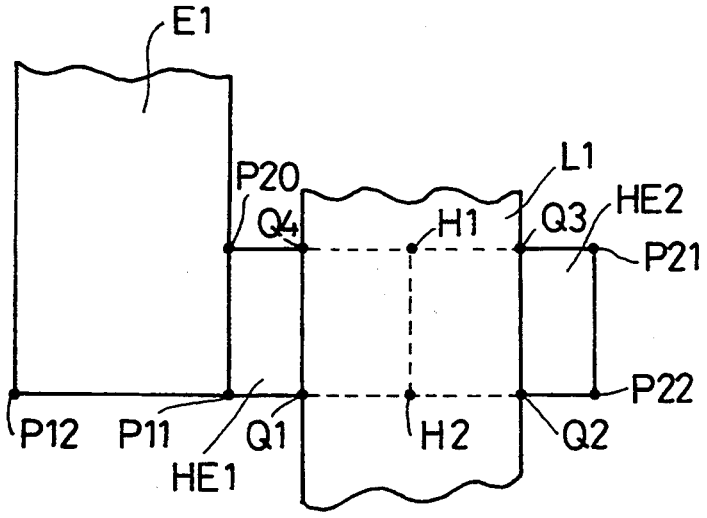
FIG. 3 is a partial diagram showing a portion corrected by a first correction processing to be performed in the sewing machine.

Then, it is determined that the stitch block E4 in the pattern "E" corresponding to the pattern number M1 (=2) and the block number B1 (=4) has four intersections Q1, Q2, Q3, and Q4 with the stitch block L1 in the pattern "L" corresponding to the pattern number M2 (=3) and the block number B2 (=1) as shown in FIG. 3, that is, the pattern "L" divides the pattern "E" arranged over the pattern "L" (S12: Yes; S13: Yes). Then, as shown in FIG. 3, a midpoint H1 between the intersection Q4 and the intersection Q3 is set, and a midpoint H2 between the intersection Q1 and the intersection Q2 is set. Then, the stitch block E4 is divided into a stitch block HE1 and a stitch block HE2 by a line segment connecting the midpoint H1 and the midpoint H2. That is, an overlapped portion between the stitch block E4 and the stitch block L1 is bisected by the line segment H1H2. Then, as shown in FIG. 9, the stitch data of the stitch block HE1 defined by four points P20, P11, H1, and H2, and the stitch data of the stitch block HE2 defined by four points H1, H2, P21, and P22 are stored into the first correction area 16B in substitution for the stitch data of the stitch block E4.

Similarly, any stitch block to be divided by the over stitch block is checked for all the remaining stitch blocks. When this check is ended, namely it is determined that the pattern number M1 is 4 (S22: Yes). Then, the second correction processing shown by the flowchart in FIG. 12A is performed.

In an initialization, the pattern number M1, the block number B2 and the block number B1 are reset to 1 and the pattern number M2 is set to 2 (S40). It is determined that the stitch block T1 in the pattern "T" has no intersections with the stitch block E1 in the pattern "E" (S41: No) and that the stitch block T1 also has no intersections with the other stitch blocks E2 to E4 in the pattern "E" (S48: No; S49, S41: No). Then, it is determined that the stitch block T1 also has no intersections with the other patterns "L," "—," and "4" (S41: No; S48 to S51). Then, as shown in FIG. 10, the stitch data of the stitch block T1 is stored into the second correction area 16C.

Figure 4B:
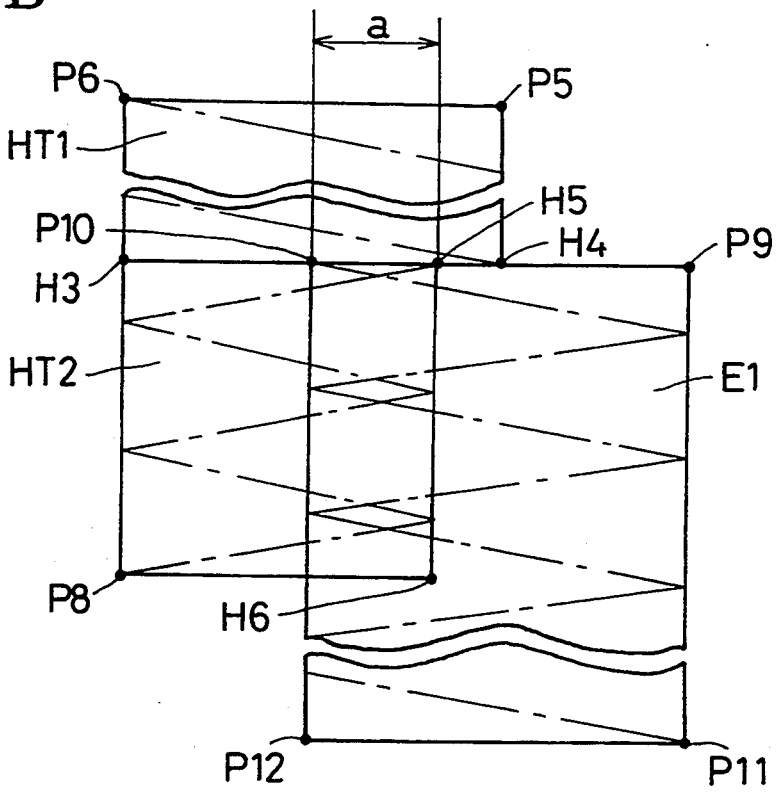
FIG. 4B is a partial diagram similar to FIG. 4A, showing the first portion after correction by the second correction processing.

Then, the block number B1 in the pattern number M1 (=1) is incremented (S52: No; S53). As shown in FIG. 4A, it is determined that the reference direction of the stitch block T2 in the pattern "T" corresponding to the block number B1 (=2) is parallel to the reference direction of the stitch block E1 in the pattern "E" and that a primary line P5P7 and a secondary line P7P8 of the stitch block T2 have intersections K1 and K2 with a secondary line P9P10 and a primary line P10P12 of the stitch block El, respectively. That is, the stitch block T2 and the stitch block E1 would harden the area of the workpiece to a highest degree by tightening of the threads in the same direction (S41: Yes; S42: No; S44: No). Accordingly, as shown in FIG. 4B, an overlapped portion between the stitch block T2 and the stitch block E1 is partially eliminated, and the stitch block T2 is divided into a stitch block HT1 defined by four points P5, P6, H4, and H3 and a stitch block HT2 defined by four points H5, H3, H6, and P8 (S45).

The stitch data of the stitch blocks HT1 and HT2 thus newly created are stored into the second correction area 16C as shown in FIG. 10 in substitution for the stitch data of the stitch block T2. By this correction, a distance d1 of the overlapped portion between the stitch block T2 and the stitch block E1 is reduced to a distance a of an overlapped portion between the stitch block HT2 and the stitch block El. Accordingly, an area to be embroidered again is reduced, and the workpiece is prevented from being exposed from a boundary portion between the stitch block HT2 and the stitch block E1.

Then, it is sequentially determined that the stitch block T2 has no intersections with the other stitch blocks, and the check for intersections relating to the pattern "T" is ended (S41: No; S48: Yes; S50: Yes; S52: Yes).

Following this, it is determined whether or not the M1 (=1) pattern "T" is a pattern just before the final pattern in the combination of patterns. Now, other patterns "E", "L" and "—" remain just before the final pattern "4" (S54: No), therefore the pattern number M1 is incremented and the block number B1 is reset to 1 (S55). The pattern number M2 is set to a number M1+1 and the block number B2 is reset to 1 (S56).

Then, similarly, the check for intersections relating to the M1 (=2) pattern "E" is performed. As shown in FIG. 5A, it is determined that the reference direction of the stitch block E3 corresponding to the block number B1 (=3) intersects the reference direction of the stitch block L1 and that a primary line P17P19 of the stitch block E3 has intersections K3 and K4 with a primary line P24P26 and a primary line P23P25 of the stitch block L1, respectively. That is, the stitch block E3 and the stitch block L1 would harden the workpiece to a medium degree by the tightening of the threads in substantially orthogonal directions (S41: Yes; S42: Yes; S60: No).

Figure 5B:
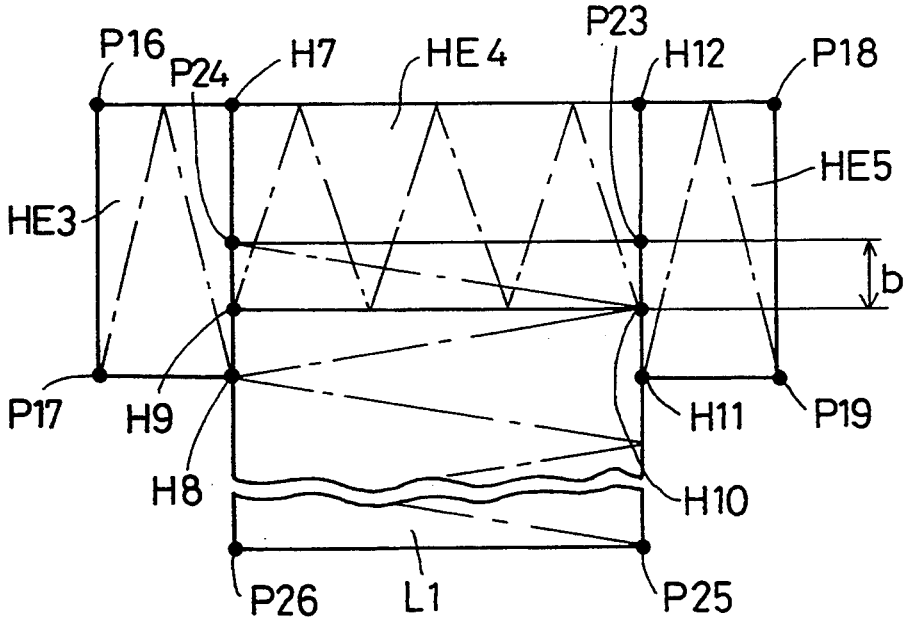
FIG. 5B is a partial diagram similar to FIG. 5A, showing the second portion after correction by the second correction processing.

Accordingly, as shown in FIG. 5B, an overlapped portion between the stitch block E3 and the stitch block L1 is partially eliminated, and the stitch block E3 is divided into a stitch block HE3 defined by four points P16, P17, H7, and H8, a stitch block HE4 defined by four points H7, H9, H12, and H10, and a stitch block HE5 defined by four points H12, H11, P18, and P19 (S63). Then, the stitch data of the stitch blocks HE3, HE4, and HE5 are stored into the second correction area 16C as shown in FIG. 10 in substitution for the stitch data of the stitch block E3. By this correction, a distance d2 of the overlapped portion between the stitch block E3 and the stitch block L1 is reduced to a distance b of an overlapped portion between the stitch block HE4 and the stitch block L1. Accordingly, an area to be embroidered again is reduced, and the workpiece is prevented from being exposed from a boundary portion between the stitch block HE4 and the stitch block L1.

Figure 6A:
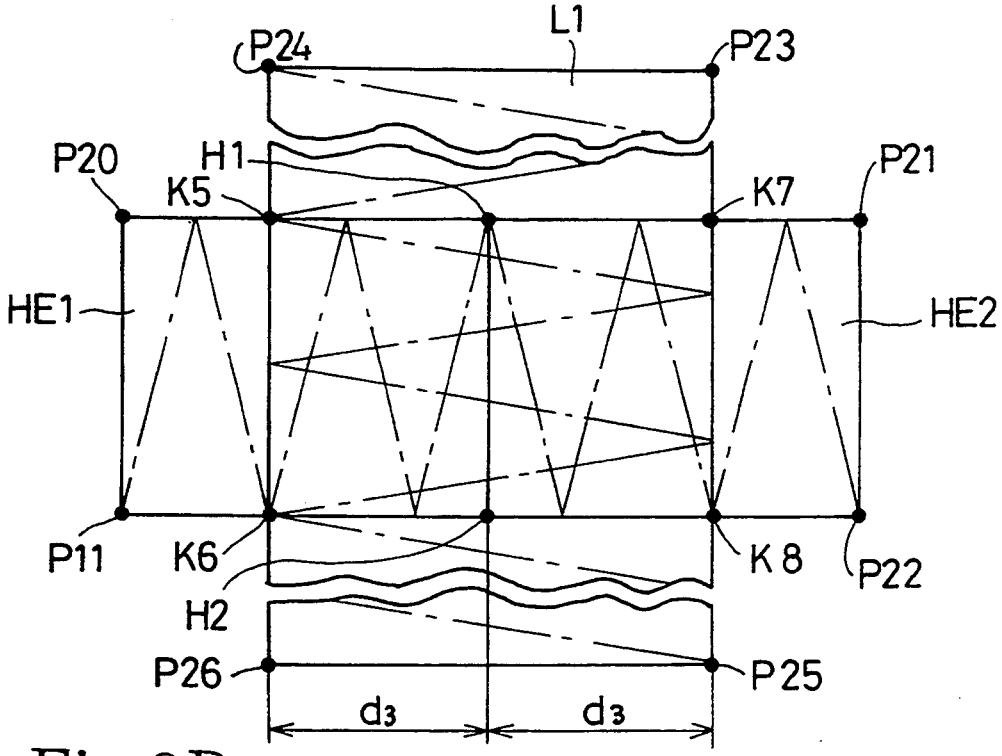
FIG. 6A is a partial diagram showing a third portion before correction by the second correction processing.

Similarly, as shown in FIG. 6A, it is determined that the reference direction of the stitch block HE1 corresponding to the block number B1 (=4) intersects the reference direction of the stitch block L1 and that a primary line P20H1 and a primary line P11H2 of the stitch block HE1 have intersections K5 and K6 with a primary line P24P26 of the stitch block L1, respectively. That is, the stitch block HE1 and the stitch block L1 would harden the area of the workpiece to a medium degree by the tightening of the threads in substantially orthogonal directions (S41: Yes; S42: Yes; S60: Yes).

Figure 6B:
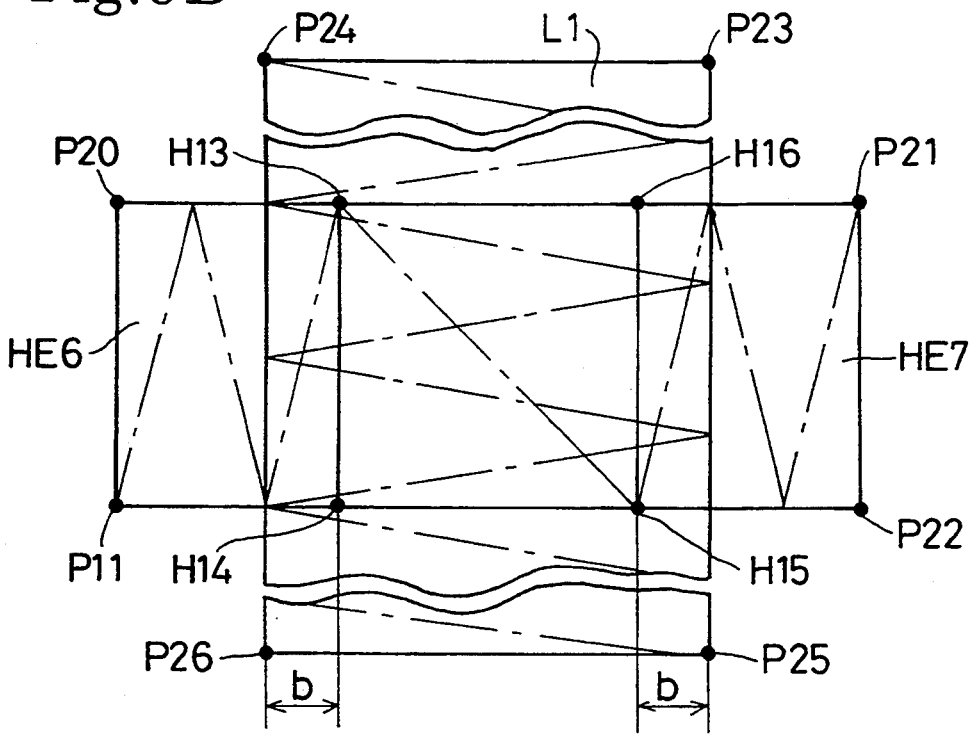
FIG. 6B is a partial diagram similar to FIG. 6A, showing the third portion after correction by the second correction processing.

Accordingly, as shown in FIG. 6B, an overlapped portion between the stitch block HE1 and the stitch block L1 is partially eliminated, and the stitch block HE1 is changed into a stitch block HE6 defined by four points P20, P11, H13, and H14 (S62). An overlapped portion between the stitch block HE6 and the stitch block L1 has a distance b in the reference direction along a primary line P20H13 of the stitch block HE6.

Then, the stitch data of the stitch block HE6 is stored into the second correction area 16C as shown in FIG. 10 in substitution for the stitch data of the stitch block HE1. By this correction, a distance d3 of the overlapped portion between the stitch block HE1 and the stitch block L1 is reduced to the distance b of the overlapped portion between the stitch block HE6 and the stitch block L1. Accordingly, an area to be embroidered again is reduced, and the workpiece is prevented from being exposed from a boundary portion between the stitch block HE6 and the stitch block L1.

Similarly, as shown in FIG. 6A, it is determined that the reference direction of the stitch block HE2 corresponding to the block number B1 (=5) intersects the reference direction of the stitch block L1, and that a primary line H1P21 and a primary line H2P22 of the stitch block HE2 have intersections K7 and K8 with a primary line P23P25 of the stitch block L1, respectively, that is, the stitch block HE2 and the stitch block L1 would harden the area of the workpiece to a medium degree by the tightening of the threads in substantially orthogonal directions (S41: Yes; S42: Yes; S60: Yes).

Accordingly, as shown in FIG. 6B, an overlapped portion between the stitch block HE2 and the stitch block L1 is partially eliminated, and the stitch block HE2 is changed into a stitch block HE7 defined by four points H16, H15, P21, P22 H14 (S62). An overlapped portion between the stitch block HE7 and the stitch block L1 has a distance b in the reference direction along a primary line H16P21 of the stitch block HE7.

Then, the stitch data of the stitch block HE7 is stored into the second correction area 16C as shown in FIG. 10 in substitution for the stitch data of the stitch block HE2. By this correction, a distance d3 of the overlapped portion between the stitch block HE2 and the stitch block L1 is reduced to the distance b of the overlapped portion between the stitch block HE7 and the stitch block L1. Accordingly, an area to be embroidered again is reduced, and the workpiece is prevented from being exposed from a boundary portion between the stitch block HE7 and the stitch block L1.

Figure 7A:
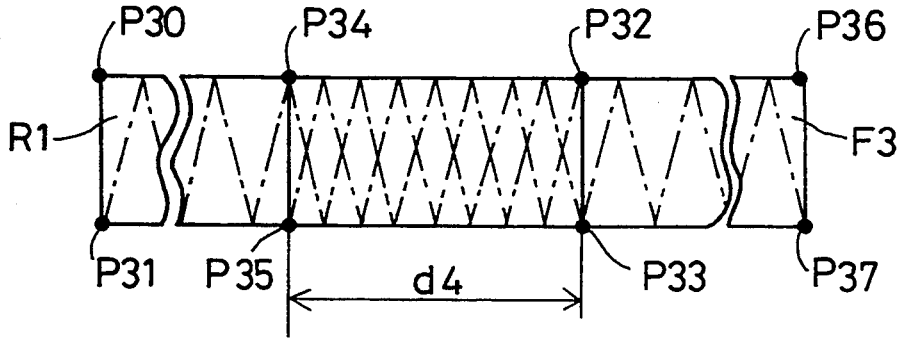
FIG. 7A is a partial diagram showing a fourth portion before correction by the second correction processing.

Then, as shown in FIG. 7A, it is determined that the reference direction of the stitch block R1 corresponding to the pattern number M1 (=4) and the block number B1 (=1) is parallel to the reference direction of the stitch block F3 corresponding to the pattern number M2 (=5) and the block number B2 (=3), and that a primary line P30P32 and a primary line P31P33 of the stitch block R1 have intersections P34 and P35 with a secondary line P34P35 of the stitch block F3. That is, the stitch block R1 and the stitch block F3 would harden the area of the workpiece to a lowest degree by tightening the threads in substantially the same manner and place (S41: Yes; s42: No; S44: Yes).

Figure 7B:
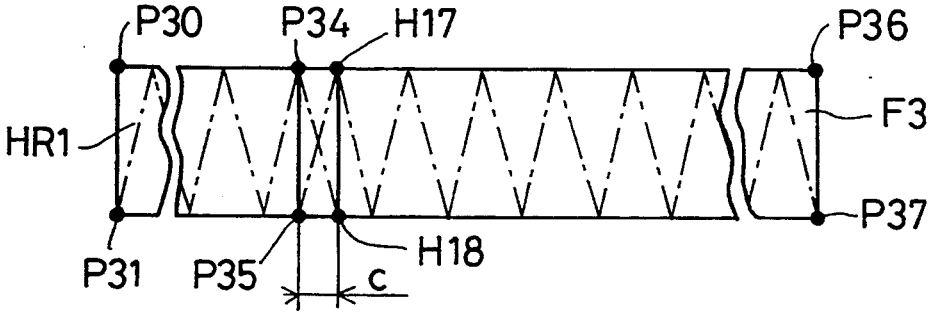
FIG. 7B is a fragmentary diagram similar to FIG. 7A, showing the fourth portion after correction by the second correction processing.

Accordingly, as shown in FIG. 7B, an overlapped portion between the stitch block R1 and the stitch block F3 is partially eliminated, and the stitch block R1 is changed into a stitch block HR1 defined by four points P30, P31, H17, and H18 (S46). An overlapped portion between the stitch block HR1 and the stitch block F3 has a distance c in the reference direction along a primary line P30H17 of the stitch block HR1.

Then, the stitch data of the stitch block HR1 is stored into the second correction area 16C as shown in FIG. 10 in substitution for the stitch data of the stitch block HR1. By this correction, a distance d4 of the overlapped portion between the stitch block R1 and the stitch block F3 is reduced to the distance c of the overlapped portion between the stitch block HR1 and the stitch block F3. Accordingly, an area to be embroidered again is reduced, and the workpiece is prevented from being exposed from a boundary portion between the stitch block HR1 and the stitch block F3.

When the check for intersections relating to all of the remaining patterns are completed, namely, it is determined that the pattern number M1 is 4 (S54: Yes), the processing of the second correction (partial elimination of overlapped portion) shown by the flowchart in FIG. 12A is ended.

After the second correction is automatically performed for each stitch block, the embroidery frame moving mechanism 24 is controlled according to the stitch data shown in FIG. 10, thus forming embroidery patterns on the workpiece. In the above second correction, the relation between the distances a, b, and c is set to $a>b>c$.

In this preferred embodiment, over-embroidering in a previously embroidered portion is reduced by creating a stitch block partially eliminated at its overlapped portion with respect to an over stitch block. As modification, a thread density in the overlapped portion of the stitch block under the over stitch block may be reduced. Further, the stitch blocks in this preferred embodiment may be reduced in size to form various patterns.

As described above, according to the present invention, an area to be embroidered in an overlapped portion between a plurality of patterns is reduced to thereby prevent a needle from being bent, thus effecting accurate embroidery.

Further, by adding means for performing control such that the higher a degree of hardening in the stitched embroidery portion from the embroideries at a boundary portion between the patterns to a workpiece, the more the embroideries in the vicinity of the boundary portion are left. Thus, the workpiece at the boundary portion can be covered with the remaining embroideries, thereby preventing a reduction in quality of embroidery.

What is claimed is:

1. A sewing machine, comprising:

storing means for storing stitch data relating to a plurality of embroidery patterns;

selecting means coupled to the storing means for selecting desired ones of the patterns to be formed based on the stored stitch data;

arranging means coupled to the selecting means for arranging the selected patterns to at least partially overlap each other;

overlap detecting means coupled to the arranging means for detecting an overlapped portion between a first pattern of the overlapped patterns and a second pattern of the overlapped patterns;

correcting means coupled to the overlap detecting means for correcting the stitch data to reduce embroidery in the overlapped portion of the first pattern; and pattern forming means coupled to the correcting means for forming the selected patterns by embroidering on a workpiece according to the corrected stitch data, wherein the correcting means comprises a hardening determining means for determining a degree of hardening resulting from a tightening of threads applied to the workpiece from the overlapping portion and for correcting stitch data in one of the overlapping patterns to adjust the area of the overlapping portion based on the determined degree of hardening.

2. The sewing machine of claim 1, wherein the correcting means corrects the stitch data of the first pattern based on the degree of hardening determined by the hardening determining means so that when a higher degree of hardening is determined, a first part of embroidery in the overlapped portion in the vicinity of the boundary portion is embroidered, and when a lower degree of hardening is detected, a second part smaller than the first part of embroidery in the overlapped portion is embroidered.

3. The sewing machine of claim 1 wherein the arranging means comprises shifting means for shifting patterns with respect to each other.

4. The sewing machine of claim 1 wherein the storing means stores the stitch data in blocks, and the overlap detecting means designates boundaries to define each block of stitch data and detects the overlapped portion by determining intersection boundaries.

5. The sewing machine of claim 1 wherein the correcting means further comprises a dividing correcting means for dividing one of the overlapping patterns into two blocks of stitch data.

6. The sewing machine of claim 1 wherein the hardening determining means adjusts the area of the overlapping portion adjacent a boundary between overlapping patterns based on the determined degree of hardening.

7. The sewing machine of claim 6 wherein the hardening determining means determines the degree of hardening based on a reference direction of the stitch data for each overlapping pattern and a position of intersecting portions of each pattern.

8. The sewing machine of claim 6 wherein the correcting means adjusts the area of the overlapping portion by reducing the stitch data in one of the patterns directly relative to a reduction in the degree of hardening.

9. The sewing machine of claim 1 wherein the pattern forming means comprises a movable embroidery frame.

10. An embroidery apparatus for controlling stitching of overlapping patterns, comprising:

a memory that stores stitch data representative of a plurality of embroidery patterns in blocks of stitch data;

a controller coupled to the memory that adjusts stitch data representative of overlapping patterns to one of a set of data for reducing the number of stitches or a set of data for reducing the length of stitches in an overlap portion of the size of overlapped patterns by reducing the overlap portion in one of the overlapped patterns; and a stitch forming device coupled to the controller that forms embroidery patterns based on the adjusted stitch data.

11. The embroidery apparatus of claim 10 wherein the controller includes an overlap determiner that sets points defining each block of stitch data and determines intersections between blocks based on the set points.

12. The embroidery apparatus of claim 11 wherein the controller divides at least one block of stitch data for an overlapping pattern into two blocks when the overlap determiner determines an intersection.

13. The embroidery apparatus of claim 11 wherein the controller includes a hardening degree determiner that determines a degree of hardening in each block of stitch data for an overlapping stitch pattern.

14. The embroidery apparatus of claim 13 wherein the controller adjusts the stitch data in at least one of the blocks of overlapping patterns based on the degree of hardening in the blocks by reducing the area of one of the overlapped blocks of stitch data.

15. The embroidery apparatus of claim 13 wherein the hardening degree determiner determines the degree of hardening by detecting a reference direction of stitches in each overlapping block of stitch data and comparing the reference directions.

16. The embroidery apparatus of claim 10 wherein the controller includes a hardening degree determiner that determines a degree of hardening in each block of stitch data for an overlapping stitch pattern, wherein the controller adjusts the stitch data in at least one of the blocks of overlapping patterns based on the degree of hardening in the blocks by reducing the area of one of the overlapped blocks of stitch data.

17. The embroidery apparatus of claim 10 further comprising a pattern arranger coupled to the memory that shifts stitch data for each pattern with respect to other patterns.

18. A method of stitching overlapping patterns, comprising the steps of:

storing stitch data for a plurality of patterns in blocks;

defining each block by setting corner points;

determining intersections between blocks based on the set points to establish overlapping blocks;

determining a degree of stitch hardening in each overlapping block;

correcting the stitch data in one of the overlapping blocks by adjusting a number of stitches or reducing a length of the stitches while maintaining stitch density of the overlapping blocks based on the degree of stitch hardening in the block; and stitching the overlapping patterns based on the corrected stitch data.

19. The method of claim 18 wherein the step of correcting the stitch data includes adjusting the number of stitches by reducing the area of the block as the degree of stitch hardening is reduced.

* * * * *